United States Patent [19]

Lesley

[11] 3,952,555

[45] Apr. 27, 1976

[54] WARP KNIT DENIM FABRICS

[75] Inventor: Bascum G. Lesley, Pickens, S.C.

[73] Assignee: Deering Milliken Research Corporation, Spartanburg, S.C.

[22] Filed: Aug. 13, 1974

[21] Appl. No.: 496,952

[52] U.S. Cl. ..... 66/195
[51] Int. Cl.[2] ..... D04B 21/00
[58] Field of Search ..... 66/190–195

[56] References Cited

UNITED STATES PATENTS

| | | | |
|---|---|---|---|
| 2,040,058 | 5/1930 | Mendel et al. | 66/176 |
| 2,114,004 | 4/1938 | Reinthal | 66/195 |

FOREIGN PATENTS OR APPLICATIONS

| | | | |
|---|---|---|---|
| 70,964 | 1/1970 | Germany | |
| 61,836 | 5/1968 | Germany | 66/195 |

OTHER PUBLICATIONS

Weigkricht, "Bindungslehre Kettenwirkerei," 1 Teil, 1950, p. 15, Abb. 55.

Weigkricht, "Bundungslehre der Kettenwirkerei," 1 Tiel, 1953, pp. 11, 24, 27, Abb. 50.

2 Glanzstoffag Construction Sheets.

*Primary Examiner*—Ronald Feldbaum
*Attorney, Agent, or Firm*—Luke J. Wilburn, Jr.; H. William Petry

[57] ABSTRACT

Warp knit denim fabrics wherein differentially colored or colorable yarn sets or groups are knit together in a fabric having a dominant, typically darker, color forming a background wherein flecks of a less dominant, typically lighter, color are present substantially uniformly throughout the surface of the fabric, thereby giving a fabric whose visual appearance is similar to woven denim fabrics, but which possesses superior fabric qualities. After knitting, the differentially colorable yarn sets may be dyed to selectively color one or more of the yarn sets. The denim effect may be enhanced by sanding or napping the denim surface of the fabric to abrade and/or break the dominant color yarns and blend the lighter color therewith. The fabric may be thereafter calendered, and finished in conventional manner.

16 Claims, 10 Drawing Figures

FIG. 3
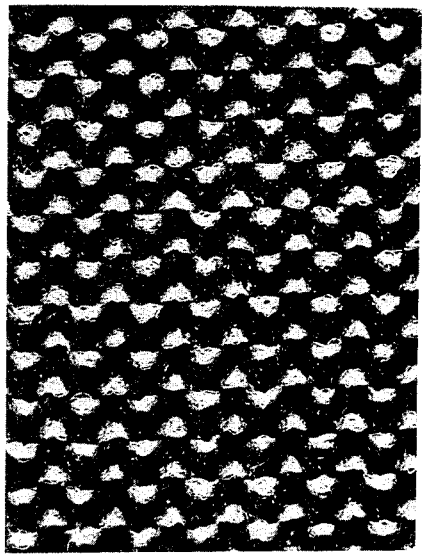
FIG. 4
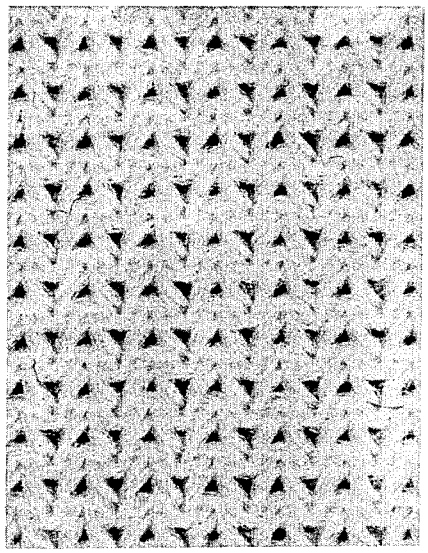
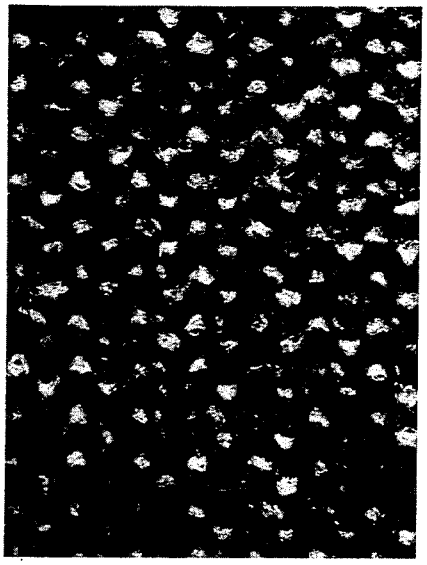
FIG. 1
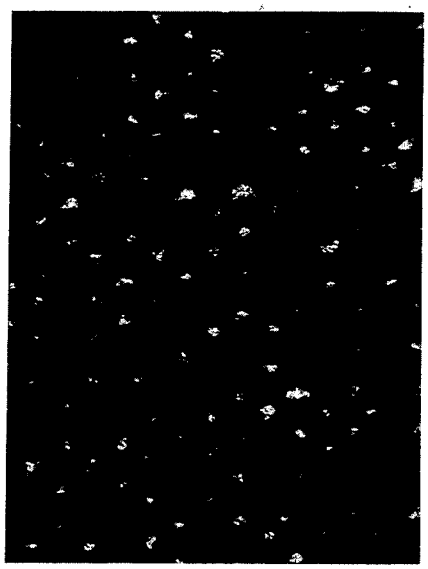
FIG. 2

WARP KNIT DENIM FABRICS

This invention relates in general to denim fabrics, and more specifically to warp knit denim fabrics.

Historically, denims have been produced from yarn-dyed spun yarns of cotton or combinations of cotton and synthetic blend spun yarns, which have been woven together to provide a fabric having a generally uniform appearance usually provided by a darker basic color throughout in which small flecks of a lighter color are substantially uniformly dispersed, thereby providing a substantially uniformly appearing fabric of colors somewhere between the darker and lighter colors. Such woven fabrics are typically quite stable, exhibiting little extensibility or stretch to accommodate body movement in garments made from such fabrics. When such woven fabrics include a substantial amount of cotton or other similar yarns, they are quite susceptible to wrinkling, and therefore do not provide preferred characteristics such as ease of care and a long lasting neat appearance.

BRIEF SUMMARY OF THE INVENTION

It is, therefore, an object of this invention to provide a denim fabric which overcomes the above-noted disadvantages. The present invention provides a denim fabric having good wrinkle resistance and improved extensibility or stretch to better accommodate body movement and provide comfort in garments made thereof, both of which contribute to the ease of care and long lasting neat appearance of such fabrics. Furthermore, the fabrics of the present invention may be piece dyed, as distinguished from the prior art wherein denim fabrics were typically made from yarn dyed yarns.

The foregoing objects and others are provided in accordance with the present invention which is a warp knit denim fabric wherein differentially colored or colorable yarns are knit together to provide a fabric wherein a dominant, typically darker, color forms a background and wherein flecks of a less dominant, typically lighter, color are present substantially uniformly throughout the surface of the fabric, thereby giving a fabric whose visual appearance is similar to woven denim fabrics, but which possesses the improved fabric qualities mentioned above. After knitting, the differentially colorable yarns may be dyed to selectively color one or more of the yarn groups as desired. The denim effect may be enhanced by sanding or napping the denim surface of the fabric to raise the dominant colored yarns and blend the lighter colored yarns therewith.

BRIEF DESCRIPTION OF THE DRAWINGS

For a better understanding of the invention as well as other objects and further features thereof, reference is made to the following detailed disclosure of preferred embodiments of the invention taken in conjunction with the accompanying drawings thereof, wherein:

FIG. 1 is a photomicrograph of the technical back side of a finished fabric made according to the present invention.

FIG. 2 is a photomicrograph of the technical back side of a fabric knit, dyed, and sanded according to the present invention, but before calendering and finishing.

FIG. 3 is a photomicrograph of the technical back side of a fabric knit and dyed according to the present invention, but before being sanded, calendered, and finished.

FIG. 4 is a photomicrograph of the technical back side of a greige fabric of the present invention.

DETAILED DESCRIPTION OF THE PREFERRED EMBODIMENTS

The warp knit denim fabrics of the present invention are made by knitting differentially colored or colorable yarns together on a warp knitting machine to provide a substantially uniform ground fabric into which other yarns are especially knit to provide the desired denim effect. After knitting, if the differentially colored or colorably yarns are not already of the desired color, the fabric may be dyed to selectively color one or more of the differentially colorable yarns. After the fabric has the desired color, the denim effect may be enhanced by napping or sanding the denim surface of the fabric to further accentuate the similarity in appearance between the inventive warp knit denim fabrics of the present invention to known and esthetically acceptable woven denim fabrics.

A preferred way of making the warp knit denim fabrics of the present invention is to knit at least two differentially colorable or colored yarn groups, hereinafter referred to as types, together using the stitch pattern Bar 1: 6-8, 2-0 (fully threaded to approximate fabric width)

Bar 2: 4-2, 0-0 (threaded one-in, one-out)

Bar 3: 4-4, 0-2 (threaded one-out, one-in)

the stitch pattern being given in Raschel designations. One type of yarns is knit according to the Bar 1 pattern, and the Bar 1 yarns thereby form a knit ground fabric structure. The other type yarns are alternately knit in two sets by the Bar 2 and Bar 3 patterns, respectively, those yarns providing the denim effect in conjunction with the aforementioned ground fabric. The number of ends of each yarn set knit by each of the Bar 2 and Bar 3 patterns is only half of the number of ends of the set of yarns knit by the Bar 1 pattern. The inventive fabric is achieved by knitting the fabric on a warp knitting machine having at least three guide bars and one needle bar (such as tricot or Raschel machines) with Bar 1 fully threaded to the approximate width of the desired fabric with the ground structure yarns, and Bars 2 and 3 threaded one-in, one-out and one-out, one-in, respectively, with the effect yarn.

Figure 5:
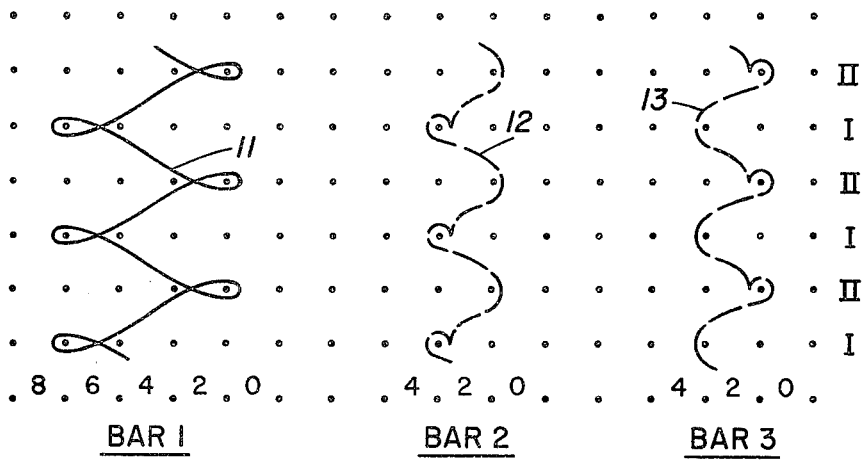
FIG. 5 is a point diagram illustrating the bar movement patterns by which each of three yarn groups or sets are knit into a fabric of the present invention.
Figure 6:
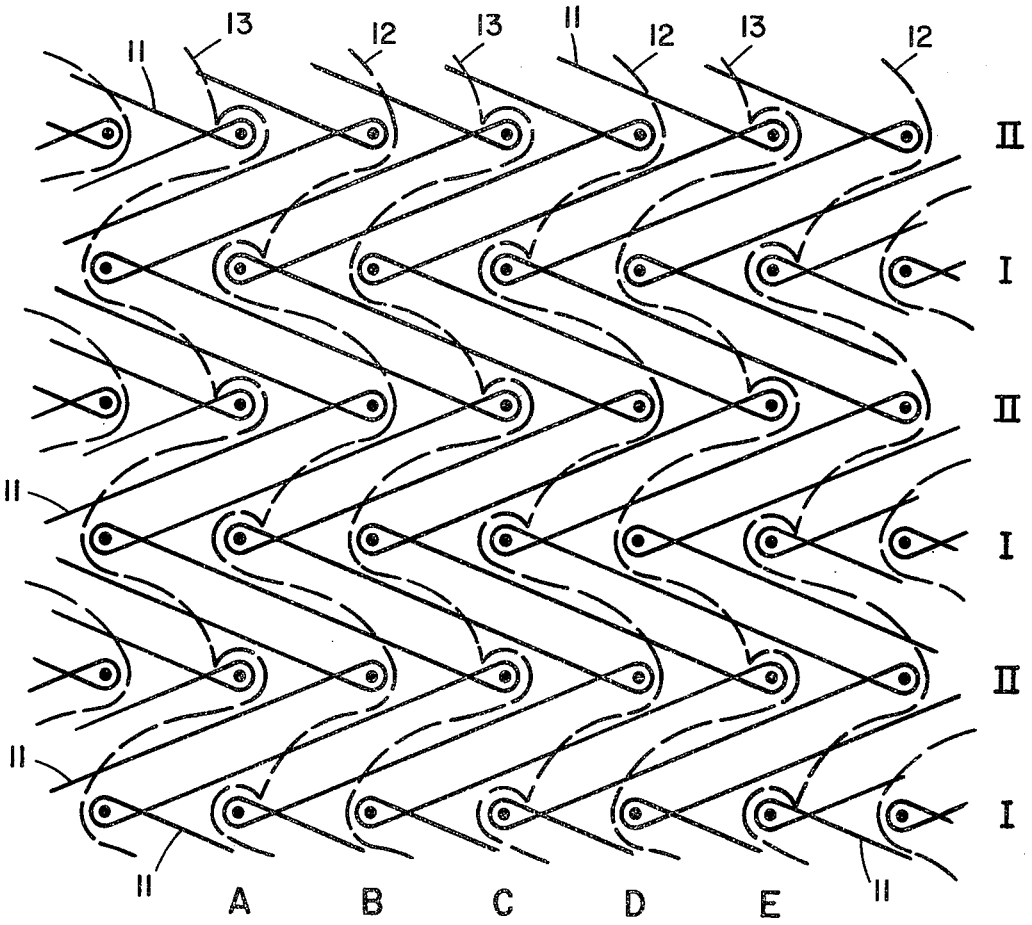
FIG. 6 is a point diagram showing in superimposed form, the stitch patterns or bar movements by which the three yarn groups or sets of FIG. 5 are knit together to form fabric according to the present invention.

The alternation of the yarns placed in the fabric by the Bar 2 and Bar 3 movement patterns is best illustrated in FIGS. 5 and 6. FIG. 5 indicates separately the movements of the three bars, with the yarns of the Bar 1 ground structure designated 11, and the Bar 2 and Bar 3 effect yarns respectively designated 12 and 13. FIG. 6 shows the three bar movement lines combined in a small section of the fabric schematically illustrated. Each of the yarn sets 12 and 13 shown in FIG. 6 alternately knits, or forms loops, and lays-in their lap portions in successive courses, and both yarns knit alternately in succeeding courses in the same wale, but only in every other wale across the fabric. For example as illustrated in FIG. 6, each of yarns 12 and 13 knit, or form loops, in wales A, C, E, but neither yarn 12 nor yarn 13 knits in wales B, D, F. While each of the yarns illustrated in FIGS. 5 and 6 repeats its knit pattern every two courses, as illustrated in courses I and II, a greater length of the pattern of each yarn, per FIG. 5, and the combined stitch pattern for the fabric, per FIG. 6, have been illustrated for purposes of greater clarity. Thus, it can be seen that the yarns of fully threaded Bar 1 knit in every course, while the yarns of half-threaded Bars 2 and 3 knit in every other course with Bar 2 knitting while Bar 3 is laying in, and vice versa.

As one skilled in the art of warp knitting will recognize, the fabric described above in conjunction with FIGS. 5 and 6 is typically produced by preparing three warps for knitting on a warp knitting machine, such as a tricot or Raschel machine. A first warp set including a number of yarn ends which corresponds approximately to the number of wales desired in the resultant fabric is mounted on the machine and the yarns are threaded through the first guide bar so that a separate end of yarn is threaded through each guide blade on the first guide bar. Second and third warp sets are prepared, each having half as many ends of yarn thereon as the first warp set, and the second and third warp sets are mounted on the knitting machine. Yarns from the second warp set are threaded through the second guide bar so that every other guide blade of the second guide bar is threaded with a separate yarn. Similarly, yarns from the third warp are threaded through the third guide bar so that every other guide blade of the third guide bar, out of phase with the second guide bar by one guide blade, is threaded with a separate yarn. The machine is equipped with the appropriate pattern chains or cams to operate the three guide bars in accordance with the stitch pattern or combination of bar movement patterns described above in conjunction with FIGS. 5 and 6. During knitting, yarns from the first bar are simultaneously pulled into loops, or knitted, on every needle across the desired fabric width on every knitting cycle of the needle bar, and each yarn end is knitted on only two non-adjacent needles in successive cycles of the needle bar. Although the three yarn warp sets have been described as being fed from separate warp beams, the second and third effect yarn sets could be fed from a single warp beam of yarns by doubling the number of ends on the beam if desired.

At the same time, the second and third warp sets of yarns are also knit into the fabric, the yarns from the second and third sets forming a plurality of pairs of yarns, one yarn of each pair coming from the second warp set and the other yarn of each pair coming from the third warp set. The yarns forming of each pair knit on every other needle of the needle bar across the desired fabric width, such that the combination of the two warp sets provides consecutive loops on every other needle during the knitting cycle. During knitting, a yarn from each pair of yarns knits only on a single needle of the needle bar, alternately knitting and then laying in on succeeding knitting cycles. At the same time the other yarn of each pair knits only on the same needle as the first yarn of the pair alternately knitting and laying in on succeeding knitting cycles, such that, when the first yarn of the pairs knits, the second yarn of the pairs lays in. Therefore, the sets of yarns of the second and third warps are alternately knitting on courses on every other wale throughout the fabric while the first warp yarn set is knitting on every course and every wale throughout the fabric.

As seen in FIG. 6, the yarns 11 of the warp set forming the ground structure of the fabric describe substantially identical, parallel paths through the fabric. Similarly, the yarns 12 of the first set of effect yarns describe substantially identical, parallel yarn paths throughout the fabric differing from the ground structure yarns, while the yarns 13 of the second set of effect yarns describe substantially identical, parallel paths throughout the fabric differing from those of the other two sets.

Figure 7:
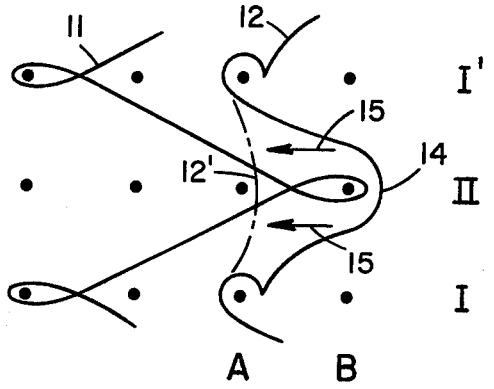
FIG. 7 is a point diagram showing the relationship between a yarn group or set of the ground fabric and a yarn group or set knit therewith to produce the desired denim effect.
Figure 8:
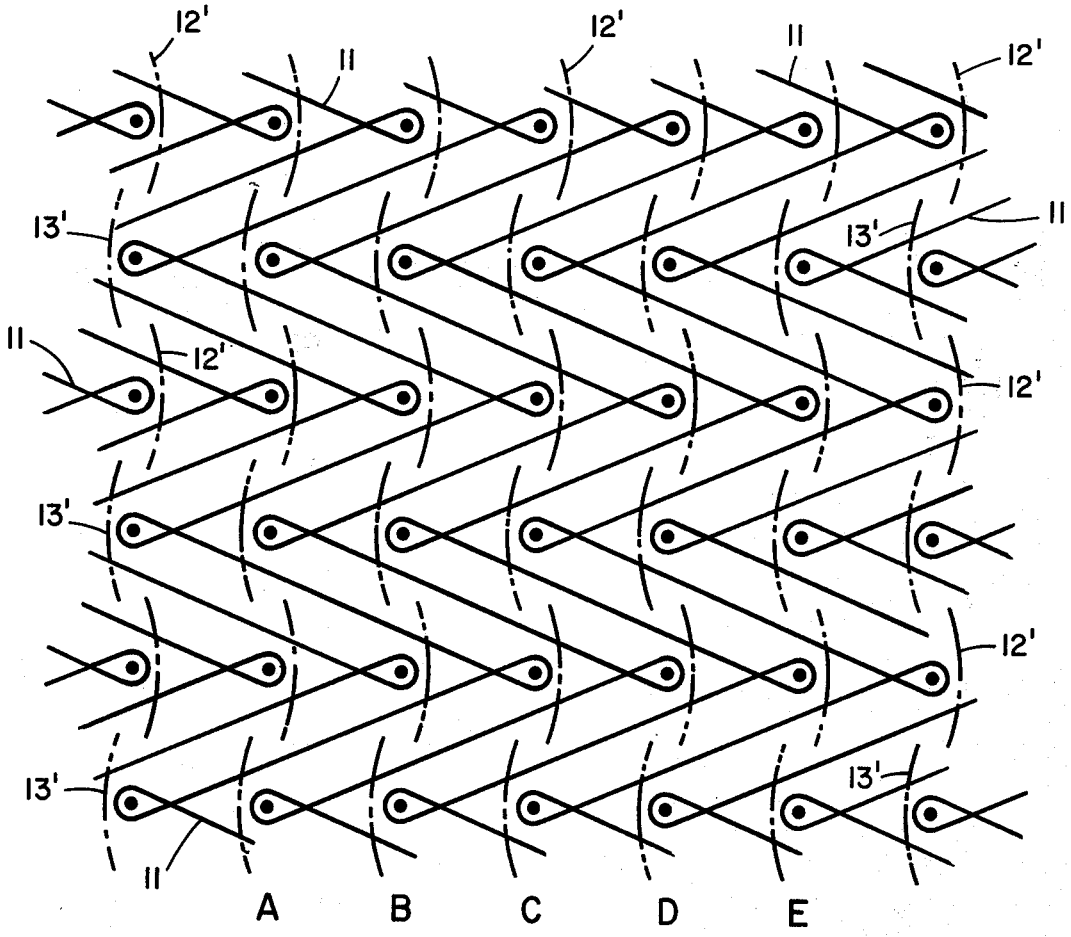
FIG. 8 is a point diagram, partially schematically illustrating the bar movement of the ground structure yarns and the resultant relationship between the lap portions of the ground structure yarns and the exposed lap portions of the effect yarn sets knit therewith to produce the desired denim effect.

While FIGS. 5 and 6 systematically illustrate the stitch patterns that the yarns individually and collectively take in the fabric of the present invention, FIGS. 7 and 8 better illustrate their final relationship and how the stitch patterns of FIGS. 5 and 6 produce the desired denim effect. FIG. 6 shows three courses I, II, I′, in which a representative portion of ground yarn 11 and a corresponding representative portion of the effect yarn 12 are isolated to better illustate their interrelation both during knitting, and as the resultant fabric comes off the knitting machine. During knitting, both yarns 11 and 12 are knit into a loop in wale I. Then yarn 11 passes over three spaces between the needles whereupon it is again knit into a loop in course II. However, in wale B, the effect yarn 12 is laid into the fabric without being pulled into a loop in course II, thereby avoiding being knit but forming a long lap which is laid in at the time and place that the ground yarn 11 is being knit in course II. Then in course I′, both yarns are again knit into loops in positions corresponding to the positions in which they were knit into loops in course I. Since the ground yarn in Bar I of the knitting machine is knit in course II, wale B, but the effect yarn 12 in Bar 2 of the knitting machine is not knit but the lap portion is laid in about the needle at course II, wale B, that laid-in lap portion of yarn 12, here labelled 14, appears on the technical back surface of the fabric and has a tendency to move laterally (as indicated by arrows 15) when the fabric is taken off the knitting elements of the knitting machine, so that it more naturally aligns itself between the two points at which yarn 12 is knit in wale A. This resultant position of the laid-in lap portion of the effect yarn 12 is indicated by the dashed line at 12′. Since the stitch pattern of the Bar 3 yarn is a mirror image of the stitch pattern of the Bar 2 yarn, except that in the courses where the Bar 2 yarn knits, the Bar 3 yarn lays-in, and vice versa, it will be appreciated that the laid-in lap portions of the Bar 3 yarn behave similarly, with respect to corresponding portions of the ground yarn 11.

This result is illustrated over a wider area in FIG. 8, wherein the short exposed lap portions of effect yarns 12 and 13, illustrated as dashed lines 12' and 13', create the desired denim effect by periodically appearing on the technical back surface over the yarns of the ground fabric. FIG. 8 also shows that these short exposed portions of the effect yarns 12' and 13' are aligned generally parallel to the wales of the fabric. This latter point is particularly advantageous in the present invention, because it allows the knit fabric, as schematically illustrated in FIG. 8, to be passed through a fabric sanding machine or over a fabric napping machine to raise the surface of the fabric in a direction parallel to the wales by breaking and/or abrading filaments of the ground yarns which extend across the wales while causing only a minimal effect in the small exposed portions of the effect yarns because they are generally parallel to the wales of the fabric. During napping or sanding it is the long laps of the ground yarn 11, which extend between and across the space defined by each alternate pair of wales in which the effect yarns are knit, which are sanded or napped up to thereby enhance the desired background color. Such a section of a lap of ground yarn 11 is shown at 16 in FIG. 6.

As previously mentioned certain further surface characteristics may be obtained in the fabric, if desired, by various treatments of the fabric after its formation. The surface of the fabric may be mechanically contacted as by sanding or napping to give it a more suede like appearance and to blend the different colors of the fabric. Preferably, the technical back surface of the fabric may be abraded or the filaments thereof broken (in multifilament yarn constructions) on conventional sanding and napping equipment. Typical of such equipment for sanding is a Curtin Hebert wide face finishing machine model 710, while napping may be accomplished with a Woonsocket Napper. Calendering of the sanded or napped fabric further assists in blending the colors on the surface of the fabric.

The colored and/or colorable yarns suitable for use in the present invention may include any textile yarns which may be knit on a warp knitting machine. The fabrics shown in FIGS. 1–4 of the drawings are composed of continuous filament yarns, the filaments of which may be abraded and/or broken in the mechanical napping or sanding operation; however, spun yarns may also be employed to provide the denim fabric of the present invention. These yarns may also be mechanically raised by sanding or napping if desired. In classic woven denims, the background color is usually darker than the effect color, which if reproduced in the warp knit denim fabric of the present invention would dictate that the ground yarn 11, would typically be a dark yarn, for example a dark blue yarn, and the effect yarns of bars 2 and 3 would be a light yarn, for example a white yarn. However the present invention also includes the use of differentially colorable yarns, which may be selectively dyed after they have been knit in the desired fabric. For example, a yarn which is a cationic dye acceptor might be used as the ground yarn, while a non-cationic dye acceptor yarn is used as the effect yarn. Thus the ground color could be placed in the knit fabric by dyeing it with a cationic dye to produce the desired color, while leaving the yarn forming the effect color, or lack thereof, in its original state. For example, one combination of yarns particularly preferred for use in the presently claimed invention is a cationic dyeable polyester yarn as the ground yarn and non-cationic dyeable polyester yarn as the effect yarn. The yarns may be textured, if desired.

A representative fabric of the presently claimed invention is illustrated at four different stages, in FIGS. 1–4. FIG. 1 is a photomicrograph of the technical back side of a blue and white polyester fabric of the present invention, which has been dyed, sanded, finished and calendered, to give a desired warp knit denim effect. FIG. 2 is a photomicrograph of the fabric which has been dyed and sanded, but not finished and calendered. FIG. 3 shows the fabric after dyeing only. The uniformity of the fabric surface can be seen to be enhanced by the mechanical surface treatment. FIG. 4 is a photomicrograph of a fabric of the present invention in the greige, before the subsequent steps mentioned above, simply showing the relationship of the yarns, without the benefit of differential coloration. The particular appearance desired in the resultant fabric will dictate the subsequent processing steps, e.g., whether the fabric is merely dyed, dyed and abraded, dyed, abraded and calendered, before finishing.

Figure 9:
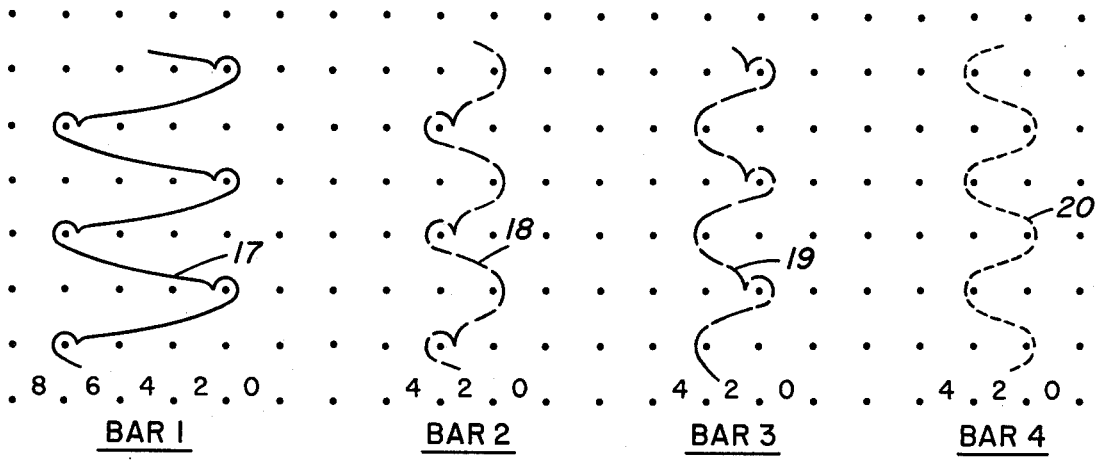
FIG. 9 is a point diagram showing individual bar movement patterns by which each of four yarn groups or sets are knit into a fabric according to the present invention.
Figure 10:
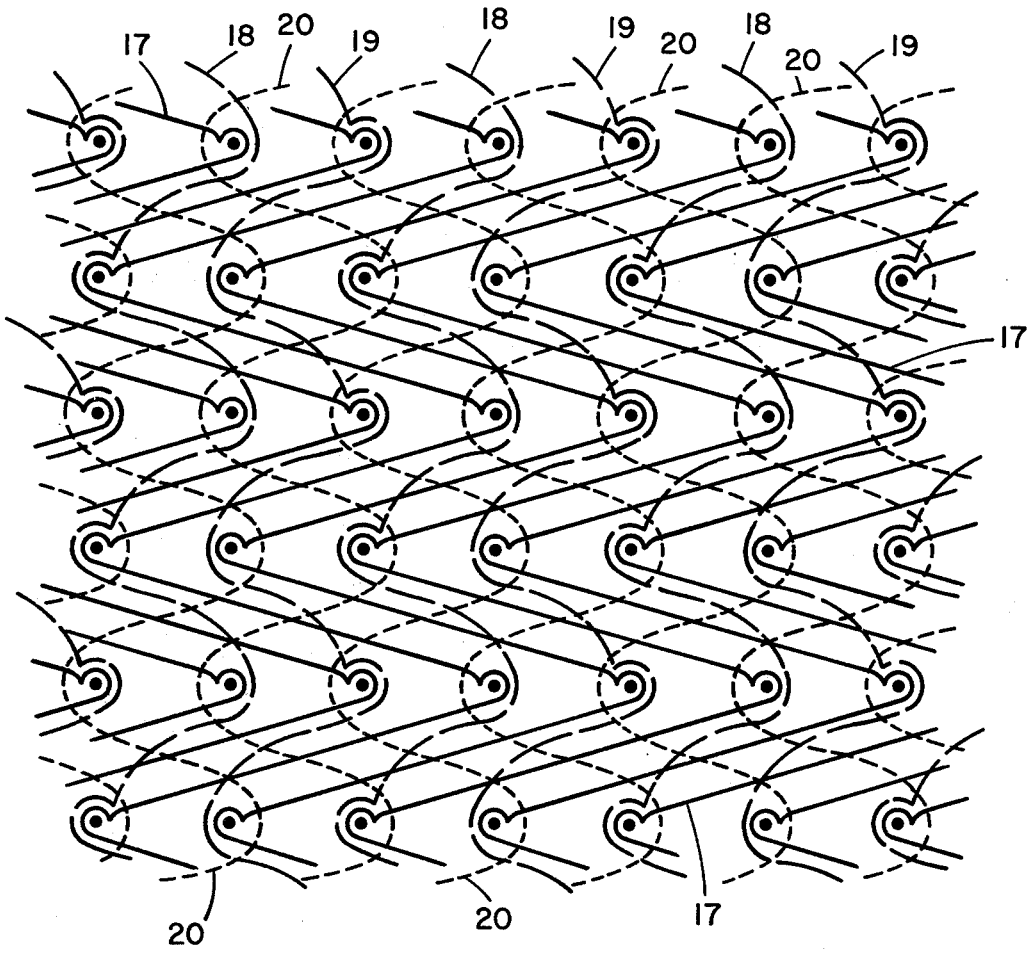
FIG. 10 is a point diagram showing in superimposed form, the stitch or bar movement patterns by which the four yarn groups or sets of FIG. 9 are knit together to form fabric according to the present invention.

While the foregoing description has been primarily directed to fabrics made according to the stitch pattern illustrated in FIGS. 5 and 6, it will be appreciated that the fabrics of the present invention may be made with still other warp knit stitch patterns. For example, the ground structure may be formed by any one bar stitch pattern wherein the yarn is knit in every course, but floats over at least one, and preferably two or more wales, between the times that it is knit into each course. The ground fabric may be knit having either open loops or closed loops, as desired. This variation is illustrated, for example, in the fabric of FIGS. 9 and 10 wherein two or three different types of yarns are knit together using the stitch pattern:

Bar 1: 8-6, 0-2 (threaded full to the approximate fabric width)
Bar 2: 4-2, 0-0 (threaded one-in, one-out)
Bar 3: 4-4, 0-2 (threaded one-out, one-in)
Bar 4: 0-0, 4-4 (threaded full to approximate fabric width)

said stitch pattern being given in Raschel designations. Again here yarn of one type coloration is knit according to the Bar 1 pattern to form a ground structure, and another type coloration yarn is alternatively knit by the Bar 2 and Bar 3 patterns to provide a fabric that contains substantially equal numbers of the Bar 1 yarn, and the total Bar 2 and 3 yarns, as previously explained with respect to the fabric illustrated in FIGS. 5 and 6. The fabric of FIGS. 9 and 10 also includes another set of yarns laid in by the Bar 4 pattern, to provide additional stability in the warp knit denim fabric of the present invention. The Bar 4 yarns are entirely laid in and do not come to the fabric surface. Therefore, Bar 4 yarns play no role in the visual denim surface effect, but they are maintained generally within the fabric to give the fabric more stability. Yarns previously discussed for use in Bars 1, 2, and 3, may be used in those bars in the fabric illustrated by FIGS. 9 and 10, while Bar 4 yarns may be of various types, but a colorless yarn, or a yarn similar in color to the ground yarn, is preferable. For example, the fabric of FIGS. 9 and 10 can be made by using cationically dyeable polyester yarns threaded full in Bar 1, non-cationically dyeable polyester yarns threaded one-in, one-out, and one-out, one-in, respectively, in Bars 2 and 3, and a colorless nylon monofilament fully threaded in Bar 4. In both FIGS. 9 and 10, the Bar 1 yarn is designated 17, the Bar 2 yarn, 18, the Bar 3 yarn, 19, and the Bar 4 yarn, 20. It will of course be appreciated that the fabric of FIGS. 9 and 10 may be made without the Bar 4 yarns, thereby providing a fabric which corresponds to the fabric of FIGS. 4 and 5, except that the ground yarn is knit having open, instead of closed loops. Although the fabrics in the drawings have been described as having a ground structure composed of either open or closed loops, it should be understood that the loops formed by any of the bars may be open or closed or various combinations of open and closed, depending upon the particular characteristics desired in the final product, without departing from the scope of the invention.

The following specific examples are intended to illustrate various preferred embodiments of the present invention.

EXAMPLE I

A 56 gauge Mayer Raschel knitting machine capable of knitting on four guide bars is threaded from four warp sets of yarns in the following manner:

Bar 1 (front bar)—Threaded full with 150 denier, 34 filament, Type 92 cationic dyeable textured Dacron (DuPont) polyester yarn. The bar movement is programmed to provide a knitting stitch 8-6, 0-2 and runner length is set at 122 inches per rack (480 courses = one standard rack).

Bar 2 — Threaded one-in, one-out with 150 denier, 34 filament, Type 56 non-cationic dyeable textured Dacron polyester yarn. The bar movement is programmed to provide a knitting stitch of 4-2, 0-0 and runner length is set at 55 inches per rack.

Bar 3 — Threaded one-out, one-in with 150 denier, 34 filament, Type 56 non-cationic dyeable textured Dacron polyester yarn. The bar movement is programmed to provide a knitting stitch of 4-4, 0-2 and runner length is set at 55 inches per rack.

Bar 4 — Threaded full with 20 denier monofilament nylon 6,6 yarn (DuPont) and programmed to provide a knitting stitch of 0-0, 10-10. The yarns of Bar 4 are laid in with the runner length of 90 inches per rack.

Bars 2 and 3 are gaited to knit on the same needle. The number of ends of yarns supplied to each bar are as follows: Bar 1-2088, Bars 2 and 3-1044 each and Bar 4-2088. The knitted fabric is taken away from the needle bar of the knitting machine at 23.4 courses per inch.

After knitting, the fabric is dyed in a single jet Gaston County pressure jet model 3-10-13. The cationic dyeable yarns of the fabric are dyed with a blue cationic dyestuff, while the non-cationic dyeable yarns are undyed and left white. Upon completion of dyeing the fabric is padded, wet through with a 2% Solusoft 100 softener, vacuum extracted, and dryed by passing the fabric through a Proctor 4 drum dryer set at 290°F. at approximately 20 yards per minute. The dried fabric is plated into a doff box.

The technical back of the dried fabric is thereafter napped by passing the fabric through a Woonsocket Napper set at the following operating conditions:

| | |
|---|---|
| Pile Roll | 200 rpm |
| Counter Pile Roll | 250 rpm |
| Feed In | 29 Yards Per Minute |
| Feed Out | 30 Yards Per Minute |

After napping the fabric is vacuum extracted and heat set by pin tentering at 350°F. for approximately 2 minutes. The fabric is thereafter calendered at 20 yds/-min. on a BF Perkins Schriner Calendar at a nip roll pressure of 50 tons per square inch and a temperature of 350°F. The finished fabric had a weight of 12.0 oz. per linear yard, a course count of 25 courses per inch, a wale count of 34 wales per inch, and a fabric width of 60 to 62 inches, measured from the tenter pin marks.

The resultant finished fabric exhibits a spun yarn-like hand and has a muted blue and white denim fabric look.

EXAMPLE II

A warp knit denim fabric according to the present invention is produced on a 56 gauge Mayer Raschel sample machine of 50 inch width. Three guide bars are used, Bar 1 being fully threaded with 1392 ends of 150 denier, 34 filament textured Dacron Type 92 cationic dyeable polyester yarn (duPont), and Bars 2 and 3 are threaded one-in, one-out, and one-out, one-in, respectively, with 696 ends of 150 denier, 30 filament Kodel Type 41U non-cationic dyeable textured polyester yarn (Eastman). A fabric is knit using the stitch pattern Bar 1: 6-8, 2-0; Bar 2: 4-2, 0-0; and Bar 3: 4-4, 0-2; with a Bar 1 (front bar) runner length of 113 inches per rack, and Bars 2 and 3 (middle and back bars) each having runner lengths of 50 inches per rack, respectively, with take up gears of 52/106.

The resultant fabric is dyed in accordance with general procedures of Example I. The technical back side thereof is then sanded by passing the fabric through a Curtin Hebert wide face finishing machine, Model 710, the sand roller surface of which moves in a direction parallel to the wales of the fabric. The specific sanding procedure is as follows: The measured fabric thickness before sanding is 39 to 44 mils and entry speed of the fabric is 10 yards per minute. Sanding roll depth setting is 18 mills, entry tension is 8 to 10 lbs. pressure per square inch, and exit tension 8 to 10 lbs. per square inch. Sanding roll speed is 760 rpm and type sanding paper is 220 grit Norton. The fabric makes two passes through the face finishing machine. The sanded fabric is then finished and calendered in accordance with the general procedures of Example I.

The resultant warp knit denim fabric approximates woven denim in appearance, but has greater extensibility, and a much softer hand.

EXAMPLE III

A warp knit denim fabric is made on a 56 gauge Mayer Raschel machine, the width of the fabric on the machine being about 74.3 inches. Three guide bars are used, Bar 1 being fully threaded with 2080 single ends of 150 denier, 34 filament Dacron Type 92 cationic dyeable polyester textured yarn. Bars 2 ad 3 were threaded one-in, one-out, and one-out, one-in, respectively, with 1040 single ends of 150 denier, 30 filament Kodel Type 41U non-cationic dyeable textured polyester yarn. The warp knit denim fabric is knit using the stitch pattern of Example I, a Bar 1 runner length of about 113 inches per rack, with Bars 2 and 3 each having a runner length of about 50 inches per rack, respectively. The greige fabric is knit to about 27.8 courses per inch and about 28 wales per inch on the machine, to produce a greige fabric of weight of about 6.0 ounces per square yarn on the machine.

The resultant fabric is then dyed as in Example I, and sanded in accordance with the general procedures of Examples II. Thereafter, the fabric is finished and calendered in accordance with the general procedures of Example I. The resultant fabric is a warp knit denim approximating the appearance of woven denim fabrics, but having improved extensibility and hand.

EXAMPLE IV

A warp knit denim fabric is produced on a 56 gauge Mayer Raschel machine, the fabric having a width of about 74.6 inches on the machine. Four bars of the machine are used, Bar 1 being fully threaded with 2088 single ends of the same type yarns of Bar 1 of Example III. Bars 2 and 3 are each threaded one-in, one-out, and one-out, one-in, respectively, with 1044 single ends of the type yarns of Bars 2 and 3 of Example III, and Bar 4 is fully threaded with 2088 single ends of 15 denier monofilament duPont semi-dull nylon. The fabric is knit using the bar movement pattern Bar 1: 8-6, 0-2; Bar 2: 4-2, 0-0; Bar 3: 4-4, 0-2; Bar 4: 0-0, 4-4; the Bar 1 runner length being about 114 inches per rack, Bars 2 and 3 each running in about 51 inches per rack, and the Bar 4 runner length being about 42 inches per rack. This produces a fabric of about 24 courses per inch and 28 wales per inch of greige fabric on the machine, the greige weight being about 5.0 ounces per square yard. The fabric is dyed as in Example I. The technical back side of this fabric is then sanded as in Example II, and finished and calendered according to general techniques of Example I. The resultant fabric is a warp knit denim having an appearance similar to woven denim, but having greater comfort extensibility than woven denim fabrics, although not as great extensibility as the fabric of Example II, above. This fabric also has better hand than woven denim fabric.

Although specific components, proportions and arrangements of elements have been stated in the above description of preferred embodiments of this invention, other equivalent components and arrangements of elements may be used with satisfactory results and various degress of quality, or other modifications may be made herein to enhance the appearance of the fabric. It will be understood that such changes of details, materials, arrangements of parts, and uses of the invention described and illustrated herein, are intended to be included within the principles and scope of the claimed invention. For example, the bar movements of the two bars carrying the effect yarns (bars 2 and 3) could be interchanged within the scope of the present invention, and the inlaid yarns of the fourth set of yarns could be knitted in the fabric if desired.

That which is claimed is:

1. A warp knit fabric comprising in combination;

a knitted ground structure comprising a set of similarly colored or colorable yarns disposed in plural, substantially identical paths throughout the structure to form a loop in every wale and in every course, the yarn of each path forming a loop in every course with successive loops being alternately positioned in two non-adjacent wales from course to course, and a plurality of sets of surface effect yarns of lighter color or colorability than said set of ground structure yarns forming loops in the ground structure, 1. the yarns of a first set of the surface effect yarns disposed in plural substantially identical paths throughout the structure to form loops only in alternate courses, the yarn of each path in said first set forming loops in each alternate course of a single wale and forming inlaid lap portions between said loops, and 2. the yarns of a second set of the surface effect yarns disposed in plural substantially identical paths throughout the structure to form loops only in intervening courses to the courses in which loops of said first set of effect yarns are disposed, the yarn of each path of said second set forming loops in each of said intervening courses of a single wale and forming inlaid lap portions between said loops, the yarns of said first and second sets of surface effect yarns forming said loops only in every other wale of the ground structure with the paths of all inlaid lap portions of yarns in said first and second sets extending in the same general direction and being exposed on the technical back surface of the ground structure and lying generally parallel to the wales thereof.

2. A warp knit fabric as defined in claim 1 wherein the set of ground structure yarns are knit into the fabric in a stitch pattern defined by the Raschel designations 6-8, 2-0.

3. A warp knit fabric as defined in claim 2 wherein the first set of surface effect yarns is knit into the fabric in a stitch pattern defined by the Raschel designations 4-2, 0-0, and wherein the second set of surface effect yarns is knit into the fabric in a stitch pattern defined by the Raschel designations 4-4, 0-2.

4. A warp knit fabric as defined in claim 1 wherein an additional set of yarns are disposed in the ground structure in a plurality of substantially identical paths throughout the structure, the yarn of each path of said additional sets of yarns being inlaid in the courses and wales of the fabric.

5. A warp knit fabric as defined in claim 4 wherein the additional set of yarns are inlaid in a pattern defined by the Raschel designations 0-0, 4-4.

6. A warp knit fabric, comprising in combination: a knitted ground structure comprising a set of yarns being knitted in every wale and each one of said yarns being knitted in every course, but only in two wales which are non-adjacent, and at least two other sets of yarns, yarn from each of said two other sets forming a plurality of pairs of surface effect yarns knit only into each alternate wale across the width of the fabric, one yarn of each of said pairs being incorporated in the fabric in a manner wherein it is repeatedly knit in a wale in a first course, and laid-in on the succeeding course, and the other yarn of each of said pairs of yarns being incorporated in the fabric in a manner wherein it is repeatedly laid-into the fabric on said first course, and knit in the same wale on the succeeding course, the laid-in portions of said yarns being exposed on the technical back surface of the fabric and lying substantially parallel to the wales of the fabric.

7. A method of manufacturing a warp knit denim fabric comprising the steps of 1. fully threading a first guide bar of a warp knitting machine with a plurality of similarly colored or colorable yarn ends, 2. half threading, one-in, one-out, a second guide bar of the warp knitting machine with a plurality of yarns of a lighter color or colorability than said first bar yarns, 3. half threading, one-out, one-in, out of phase with the threading of said second bar yarns, a third guide bar of the warp knitting machine with a plurality of yarns of said lighter color or colorability, and
4. operating said warp knitting machine to cause said bars to pass about the needles of the warp knitting machine to form a warp knit denim fabric in accordance with the following bar movements defined by the Raschel designations:

| | |
|---|---|
| First Bar | 6–8, 2–0 |
| Second Bar | 4–2, 0—0 |
| Third Bar | 4–4, 0–2 |

8. A method as defined in claim 7 including the further step of mechanically contacting the technical back of said fabric so produced to raise the first bar yarns, and thereafter finishing and calendering said fabric.

9. A method as defined in claim 8 including the step of dyeing the fabric to provide a darker color to said first bar yarns than said second and third bar yarns.

10. A method of knitting a warp knit denim fabric from at least three sets of yarns comprising the steps of:

1. knitting a first set of yarns to form a knit ground structure containing a stitch in every course and wale with each yarn in the set forming stitches in only two wales and crossing at least one wale between successive stitches,
2. simultaneously knitting a second and third set of yarns into the ground structure to provide stitches in every course of the ground structure but only in every other wale, with the yarns of said second set forming stitches only in alternate courses and said third set only in intervening courses to said alternate, and
3. laying-in said second and third sets of yarns on the courses in which they do not form stitches, so that the laid in portions of said second and third yarn sets appear as yarn sections on the technical back surface of the ground structure which sections lie generally parallel to the wales over portions of said first set of yarns.

11. A method as defined in claim 10 wherein the fabric is knit on a warp knitting machine and the three sets of yarns are supplied to the knitting needles of the knitting machine from three guide bars, respectively, said first set being threaded full on the first guide bar of the machine, said second set being threaded one-in, one-out on a second guide bar of the machine, and said third set being threaded one-out, one-in on a third guide bar of the machine, and wherein said sets are knit by moving the guide bars about the needles in the following pattern defined by the Raschel designations:

| | |
|---|---|
| Bar 1: | 6–8, 2–0 |
| Bar 2: | 4–2, 0—0 |
| Bar 3: | 4—4, 0–2 |

12. A method as defined in claim 11 wherein the first bar of the knitting machine is moved in a bar movement pattern defined by the Raschel designations 8-6, 0-2.

13. A method as defined in claim 11 comprising the additional step of simultaneously laying in a fourth set of yarns from a fourth guide bar to position the yarns generally crossing the wales of the ground structure.

14. A method as defined in claim 13 wherein a fourth set of yarns is laid into the fabric in a bar movement pattern defined by the Raschel designations 0-0, 4-4.

15. A method of manufacturing a warp knit denim fabric, comprising: simultaneously knitting on a warp knitting machine having one needle bar and at least three guide bars, 1. a first warp comprising a plurality of similarly colored or colorable yarns, with an individual yarn from said warp knitting on each needle across the desired fabric width on every cycle of the needle bar and alternating, between only two non-adjacent needles in successive cycles of the needle bar, and
2. second and third warps, each comprising a plurality of surface effect yarns lighter colored or colorable from said first warp, the yarns from said second and third warps forming pairs of yarns, one yarn of each pair coming from said second warp and the other coming from said third warp, the yarns of said pairs knitting on only every other needle across the desired fabric width, one yarn from each of said pairs repeatedly knitting on a needle on one cycle of the needle bar and laying-in on the succeeding cycle of the needle bar, and the other yarn from each of pair repeatedly laying-in on said one cycle of the needle bar, and knitting on said needle during said succeeding cycle of the needle bar.

16. The method of claim 15, wherein the second and third of the three guide bars repeatedly move in a combination of bar movement patterns defined by the Raschel designations: Second Bar: 4-2, 0-0; Third Bar: 4-4, 0-2.

* * * * *